United States Patent [19]

Gotoh et al.

[11] Patent Number: 4,932,107

[45] Date of Patent: Jun. 12, 1990

[54] METHOD OF REDUCING OPEN SPACES IN WOVEN FABRICS

[75] Inventors: Hazime Gotoh; Tadasi Yokoti, both of Nagoya, Japan

[73] Assignee: Mitsubishi Rayon Company, Ltd., Tokyo, Japan

[21] Appl. No.: 382,000

[22] Filed: Jul. 17, 1989

Related U.S. Application Data

[63] Continuation of Ser. No. 227,657, Aug. 3, 1988, abandoned.

[30] Foreign Application Priority Data

Aug. 3, 1987 [JP] Japan ..... 62-194188

[51] Int. Cl.[5] ..... D06C 15/02

[52] U.S. Cl. ..... 28/137; 28/140; 26/1

[58] Field of Search ..... 28/140

[56] References Cited

U.S. PATENT DOCUMENTS

| | | | |
|---|---|---|---|
| 3,451,332 | 6/1969 | Kesler | 100/162 R |
| 3,669,158 | 6/1972 | Phillips | 139/420 R X |
| 3,677,855 | 7/1972 | Bolliand | 28/282 X |
| 3,905,288 | 9/1975 | Holm | 100/162 R |
| 3,908,808 | 9/1975 | Busker | 68/3 SS X |
| 3,955,256 | 5/1976 | Park | 28/165 |
| 4,211,165 | 7/1980 | Schill | 100/162 R |
| 4,564,297 | 1/1986 | Firth | 68/3 SS X |

FOREIGN PATENT DOCUMENTS

| | | | |
|---|---|---|---|
| 2268895 | 4/1975 | France . | |
| 2277923 | 7/1975 | France . | |
| 2509760 | 7/1982 | France . | |
| 52-25122 | 2/1977 | Japan . | |
| 56-43435 | 4/1981 | Japan . | |
| 63-106791 | 12/1986 | Japan . | |
| 721280 | 1/1955 | United Kingdom | 28/137 |

*Primary Examiner*—Werner H. Schroeder
*Assistant Examiner*—David K. Suto
*Attorney, Agent, or Firm*—Oblon, Spivak, McClelland, Maier & Neustadt

[57] ABSTRACT

Disclosed is a method wherein open spaces in woven fabrics useful as industrial materials, such as coated cloth and cloth for fiber-reinforced plastics, are reduced by allowing the woven fabrics to pass under pressure between a pair of rolls at least one of which vibrates in the axial direction thereof.

1 Claim, 2 Drawing Sheets

METHOD OF REDUCING OPEN SPACES IN WOVEN FABRICS

This application is a continuation of application Ser. No. 227,657, filed on Aug. 3, 1988, now abandoned.

BACKGROUND OF THE INVENTION

1. Field of the Invention:

The present invention relates to a novel method of reducing open spaces which are found in woven fabrics whose fabric density is low relative to the diameter of yarns used, and more particularly to a novel method of reducing open spaces in woven fabrics used as industrial materials, such as coated cloth and cloth for fiber-reinforced plastics.

2. Description of the Related Art:

Among various types of fabrics used as industrial materials, many of those fabrics that are used as sheets have a relatively coarse density and employ a mesh structure. If such fabrics are provided with a coating such as a rubber coating, there are cases where irregularities occur on their surfaces, thereby deteriorating their product value. In addition, in the cloth for fiber-reinforced plastics (hereafter abbreviated as FRP), fibers and resin exist separately, resulting in the deterioration of the physical properties of FRP.

The mesh structure (openings in the meshes) of such cloth sometimes causes a problem, but there has been no effective means for eliminating open spaces in woven fabrics that are found in the structure of such cloth. Hence, a measure has conventionally been taken to reduce open spaces in woven fabrics by increasing the density of yarns constituting the cloth.

However, the method of reducing open spaces in woven fabrics by such means is not economically desirable, and there has been demand for reducing open spaces in woven fabrics without changing the density of the fabrics. In particular, yarns which constitute fabrics used for FRP are highly resilient and brittle. If a reducing method using a press, which is still unsatisfactory in reducing open spaces in woven fabrics, is employed, the fibers are susceptible to breakage. Hence, the present situation is such that there is no appropriate method available.

SUMMARY OF THE INVENTION

Accordingly, an object of the present invention is to provide a novel method of reducing open spaces in woven fabrics so as to obtain fabrics having a low void ratio, thereby overcoming the above-described drawback of the conventional art.

To this end, according to the present invention, there is provided a method of reducing open spaces in woven fabrics, comprising allowing the woven fabrics to pass under pressure between a pair of rolls at least one of which vibrates in the axial direction thereof.

The above and other objects, features and advantages of the present invention will become more apparent from the following detailed description of the invention when read in conjunction with the accompanying drawings.

DESCRIPTION OF THE PREFERRED EMBODIMENT

Referring now to the accompanying drawings, a detailed description will be given of the present invention.

Figure 1A:
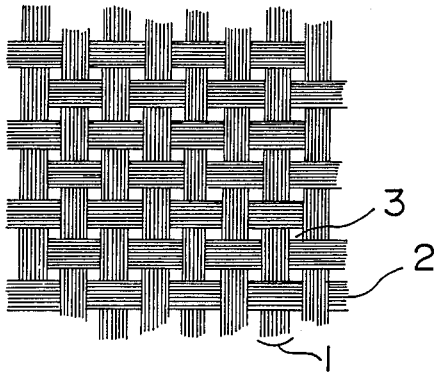
FIG. 1A is a top plan view of fabrics having open spaces.
Figure 1B:
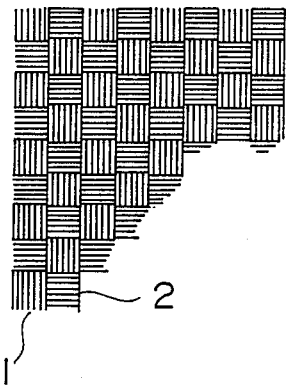
FIG. 1B is a top plan view of fabrics having no open spaces.

FIG. 1 illustrates a state in which meshes of the cloth are open. In FIG. 1A, the cloth comprising the warps 1 and the wefts 2 generally has open spaces 3, and the coarser the fabric density of the warps and the wefts, the greater the ratio of the area of the open spaces to the entire area of the cloth. Preferably, the cloth for coating or FRP should have no open spaces, as shown in FIG. 1B. The ratio of the area of open spaces to the entire area of the cloth is defined by a void ratio and is shown by a percentage. The void ratio of the cloth shown in FIG. 1A is approximately 11%, while the void ratio of the cloth shown in FIG. 1B is 0.

As described above, the object of the present invention is to provide a novel method of eliminating open spaces in woven fabrics so as to obtain fabrics having a low void ratio. Component elements for implementing the present invention will be described with reference to FIG. 2 and onward.

Figure 2:
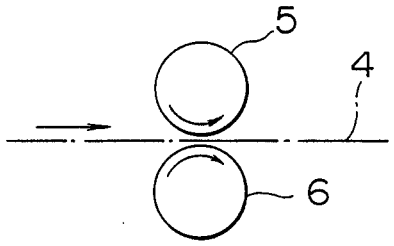
FIG. 2 is a side elevational view of a mechanism illustrating component elements in accordance with the present invention.

In FIG. 2, cloth 4 is allowed to pass between a pair of rolls 5, 6, and the surface speeds of the rolls 5, 6 are identical with the passing speed of the cloth 4. In the method of the present invention, either or both of the rolls 5, 6 are made to vibrate in the direction of the rotational axes of the rolls, and the cloth 4 is pressurized by the rolls 5, 6. In other words, the present invention provides a method of eliminating open spaces in woven fabrics in which the cloth is allowed to pass under pressure between a pair of rolls at least one of which vibrates in the axial direction of the rolls.

Although either or both of the rolls 5, 6 are adapted to vibrate in the direction of the rotational axes of the rolls, when both of the rolls vibrate, it is necessary that the vibrating directions of the rolls are opposed to each other. In this case, forces acting on the cloth 4 are basically identical with the action applied to the cloth in the case where one roll is made to vibrate. Therefore, a description will be given of a case where either one of the rolls is made to vibrate.

In FIG. 2, the roll 5 is a vibrating roll, while the roll 6 is a fixed roll. It is necessary that the vibrating roll 5 vibrates in the axial direction thereof and is operative to press the cloth 4.

Figure 3A:
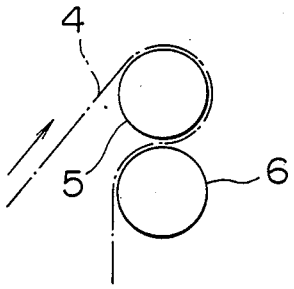
FIGS. 3A and 3B are side elevational views of specific examples of the mechanism used in implementing the present invention.

A pair of rolls which operates as described above is shown in FIG. 3A. In this drawing, the roll 5 is the vibrating roll, and the pressing of the cloth 4 can be effected by applying tension to the cloth 4, so that a structural arrangement can be made simple. As shown in FIG. 3, if the cloth 4 passes making contact with the outer peripheries of the rolls 5, 6 over some distance which is preferably more than 1/6 of the outer peripheral length of the roll 5 or 6, the cloth 4 is stationarily held on the outer surfaces of rolls 5, 6, and therefore, when the roll 5 is vibrated, the cloth 4 is subjected to crumpling action at the contact point defining a nipline between the rolls 5, 6 in a direction slant to the direction of pass of the cloth 4, causing the warps and the wefts to effect remarkable width enlarging action. Accordingly, the configuration shown in FIG. 3A is excellent in comparison with that shown in FIG. 2, and further, the configuration shown in FIG. 3B is more excellent than that of the former.

Figure 3B:
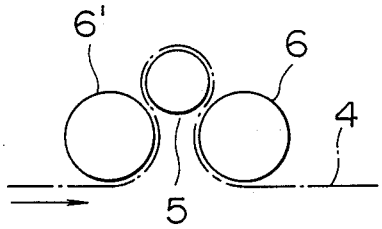

Furthermore, FIG. 3B illustrates another embodiment of the present invention in which the vibrating roll is placed on the two fixed rolls 6, 6'. This arrangement makes it possible to stabilize the vibrating roll and apply pressure to the cloth 4 at two points of contact between the vibrating roll 5 and the fixed rolls 6, 6' as tension is applied to the cloth 4. This is structurally the most simple and most effective method. According to this method, it is possible to enhance the efficiency by providing an (n−1) number of vibrating roll on an n-number of fixed rolls. However, the method of applying pressure to the cloth while a roll is being vibrated is not confined to the above-described methods. A method of loosening the thread-like materials to enlarge the width thereof by passing the same over a non-rotating stationary cylindrical member on vibration is already known as is disclosed in Japanese Laid-Open No. 56-43435, but the above-mentioned method only utilizes rubbing action alone. Therefore, the concept of the present invention is completely different from that of this method.

Further, Japanese Patent Laid-Open No. 52-25122 proposes the use of rubbing rolls which have been heretofore used in comb-spinning. However, this method is adapted to be used only for the loosening of a two-like material in which fibers are laid in one and the same direction. Further, the Japanese Patent Laid-Open does not concern the treatment of cloth composed of warps and wefts and having an extremely high binding force. Further, the above-mentioned method does not offer the crumbling effect in a direction slant to the travelling direction of the cloth, and therefore, cannot be used for the treatment of cloth.

In the present invention, basic factors that provide the effect of eliminating open spaces in woven fabrics are the frequency of the vibrating roll 5 and the pressure at the point of contact between the vibrating roll 5 and the fixed roll 6. As other factors which may be employed, it is possible to employ such auxiliary means as heating, depending on the material of the cloth. However, a description will be given of the effect of the frequency of the vibrating roll and the pressure, i.e., the basic factors, which is shown in FIG. 4.

Figure 4:
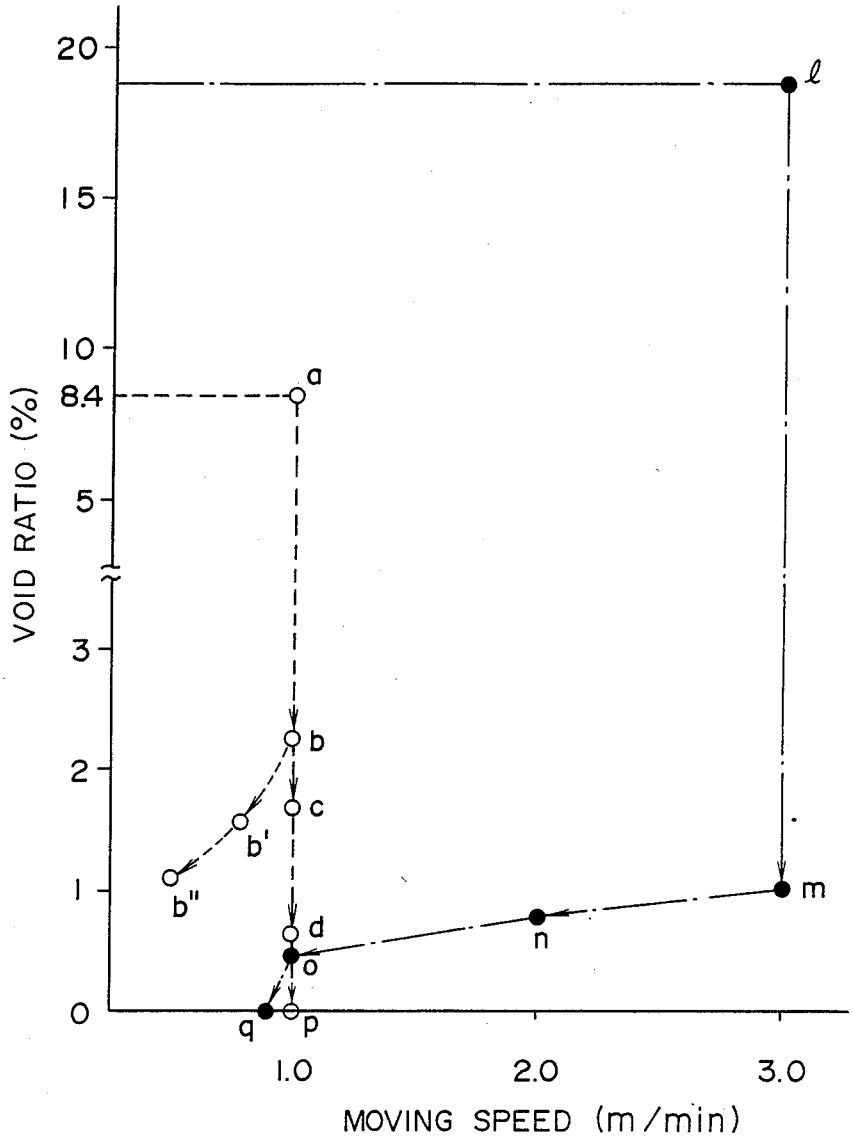
FIG. 4 is a graph of the relationships between the void ratio and the frequency, tension, and the moving speed of a cloth.

The vibrating roll used in an experiment shown in FIG. 4 had a diameter of 60 mm, and a piston-type vibrator (Type NTK-15X made by Nottor Inc.) was used as the vibrator.

In FIG. 4, the void ratio of plain woven cloth having a density of 12.5 ends/in.×and 12.5 picks/in. and produced by using 3K carbon fiber tow was 8.4% (point a). When this cloth was subjected to processing at a frequency of 1,300 cycles/min., cloth tension of 50 g/cm (in proportion to which the pressure at the point of contact between the vibrating roll 5 and the fixed roll 6 is produced), at a moving speed of 1.0 m/min at 60° C., 2.3% (point b) was obtained as the void ratio. Furthermore, when the frequency alone was increased from 1,300 cycles/min. to 1,700 cycles/min., 1.7% (point c) was obtained, which demonstrates the effect of an increase in the frequency. In addition, when cloth tension was set to 200 g/cm in the conditions of point b (1,300 cycles/min., 50 g/cm and 1 m/min.), 0.7% (point d) was obtained as the void ratio. When the moving speed was set to 0.76 m/min. and 0.5 m/min. (i.e., the same effect as an increase in the frequency) in the conditions of point b, it was possible to obtain void ratios of b' and b''.

Furthermore, when cloth (void ratio: 18.70% at point l) formed of 3K tow of carbon fibers and having a density of 12.5 ends/in.×6 picks/in. was subjected to processing under the same conditions as the above-described point b (however, the moving speed was set to 3 m/min.), a void ratio of 10% was obtained. When the moving speed was lowered consecutively to 2 m/min. and 1 m/min., 0.75% (point n) and 0.5% (point o) were obtained, respectively. In addition, as the frequency was set to 1,700 cycles/min. and cloth tension was set to 200 g/m, cloth having no open spaces were obtained with void ratios of 0 at points p and q. Thus, the effect of the frequency of the vibrating roll and the pressure which are the basic elements in the present invention became clear.

The present invention will be described specifically on the basis of reference examples.

The "void ratio" was calculated on the basis of $$\text{Ratio of area}\left(=\frac{\text{transmitted area}}{\text{area of fabrics}}\times 100\right)$$

by photographing the fabrics by allowing light to be transmitted therethrough from one side thereof.

EXAMPLE 1

In the arrangement of the rolls shown in FIG. 3B, a piston-type vibrator was installed at one end of a steel pipe of a 60 mm diameter as the vibrating roll 5. This vibrating roll was placed on the fixing rolls 6, 6' each having a 125 mm diameter.

Meanwhile, a piece of plain woven cloth (12.5 ends/in. and 12.5 picks/in.), in which non-twisted tow (hereafter abbreviated as 3K) having a bundle of 3,000 carbon fibers of a 7–8 μm diameter was used as the warp and the weft, was allowed to pass, as shown in FIG. 3B. cloth tension at this time was 200 g/cm, the frequency of the vibrating roll was approx. 800 cycles/min., the amplitude was approx. 1 mm, and the moving speed of the cloth was 0.5 m/min.

Although the void ratio of the cloth to which the method of the present invention was not applied was about 6.2%, the void ratio of the cloth which was subjected to reduction of open spaces, according to the present invention was 0.2%, and it was verified that the present invention produces a substantial effect in reducing the void ratio.

REFERENCE EXAMPLE 2

A piece of plain woven cloth having a density of 10 ends/in. and 6 picks/in. was prepared by using 3K carbon fiber tow as the warp and the weft. The void ratio of this cloth was about 11.8%. When this cloth was subjected to reduction of the open spaces under the conditions shown in Example 1, it was possible to obtain cloth having a void ratio of 0.

As has been described above in detail, the method of the present invention is structurally simple and is an excellent method of reducing the void ratio. The coated cloth using the cloth material thus obtained excels in smoothness, and facilitates the impregnation with resin when used for FRP. In other words, in a method of impregnating pieces of FRP-use cloth with resin supplied in the form of film while superposing pieces of such FRP-use cloth, if ordinary cloth having open spaces is used, the resin will first enter the open spaces, and reach the surface of the cloth without wetting the entire fibers, forming a resin film on the cloth surface. As a result, a foam is left in the fibers, so that it is impossible to obtain complete cloth prepreg. In contrast, in the cloth whose open spaces have been reduced, after the fibers have been wetted, the resin spreads to the cloth surface (since there is no short pass), and no foam is left in the fibers, so that the fibers can be wetted completely. Thus it is possible to obtain cloth prepreg which excels in quality.

The advantage of the method of reducing open spaces in accordance with the present invention, that is the enhanced resin impregnating capabilities offers an extremely high value.

When a cross section of moldings was observed which was formed by impregnating with epoxy resin the cloth subjected to a reduction of open spaces in accordance with the method of the present invention, it was verified that the distribution of fibers and resin was uniform.

Obviously, numerous modifications and variations of the present invention are possible in light of the above teachings. It is therefore to be understood that within the scope of the appended claims, the invention may be described otherwise than as specifically described herein.

What is claimed as new and desired to be secured by Letters Patent of the United States is:

1. A method of reducing open spaces in woven fabrics each comprised of warp tows and weft tows, each of said tows including a plurality of filaments laid flat, comprising the steps of:

feeding a woven fabric in a warp direction in which said warp tows are extended longitudinally so as to lead said woven fabric to a nip line between a pair of rolls;

passing said woven fabric under pressure between said pair of rolls whose center axes extend substantially orthogonal to said warp direction, said nip line being parallel with said center axes;

leading said woven fabric along said pair of rolls so as to cause said woven fabric to stick to each of said pair of rolls over at least one-sixth of an entire periphery thereof on both sides of said nip line; and oscillating at least one of said rolls axially thereof, relative to each other.

* * * * *